United States Patent [19]

Kopper

[11] Patent Number: 4,826,608

[45] Date of Patent: May 2, 1989

[54] WORM CENTRIFUGE

[75] Inventor: Michael Kopper, Norcross, Ga.

[73] Assignee: Klöckner-Humboldt-Deutz Aktiengesellschaft, Fed. Rep. of Germany

[21] Appl. No.: 76,025

[22] Filed: Jul. 21, 1987

[30] Foreign Application Priority Data

Jul. 19, 1986 [DE] Fed. Rep. of Germany ..... 3624536

[51] Int. Cl.[4] ..... B01D 33/02; B04B 1/20; B04B 3/04

[52] U.S. Cl. ..... 210/781; 210/374; 210/383; 210/394; 494/36; 494/54

[58] Field of Search ..... 210/781, 784, 374, 378, 210/383, 394, 403; 494/53, 54, 36, 37; 100/117

[56] References Cited

U.S. PATENT DOCUMENTS

| | | | |
|---|---|---|---|
| 1,756,194 | 4/1930 | Haug | 210/781 |
| 3,348,767 | 10/1967 | Ferney | 494/53 |
| 3,401,801 | 9/1968 | Wedemeyer et al. | 210/394 |
| 4,449,967 | 5/1984 | Caldwell | 494/54 |

FOREIGN PATENT DOCUMENTS

| | | | |
|---|---|---|---|
| 3043717 | 7/1982 | Fed. Rep. of Germany . | |
| 2064997 | 6/1981 | United Kingdom | 494/36 |

*Primary Examiner*—Richard V. Fisher
*Assistant Examiner*—Linda S. Evans
*Attorney, Agent, or Firm*—Hill, Van Santen, Steadman & Simpson

[57] ABSTRACT

In known worm centrifuges comprising a solid bowl and a sieve bowl, a cleaning and predewatering of the solids/liquid mixture occurs in the solid bowl when dewatering solids/liquid mixtures and an after-dewatering of the solids occurs in the following sieve bowl. In general, a relatively good cleaning and dewatering effect is achieved with such previously-known worm centrifuges comprising a solid bowl. According to the invention, the after-dewatering effect in the sieve bowl can be quite substantially increased in that the conveyor worm is provided with agitator elements in the region of the sieve bowl, the agitator elements immersing into the solids layer. As a result thereof, in particularly, a circulation of the solids layer is achieved in the sieve bowl in a very advantageous manner and, as a result thereof, the after-dewatering of the solids before discharge from the worm centrifuge is very substantially improved.

6 Claims, 1 Drawing Sheet

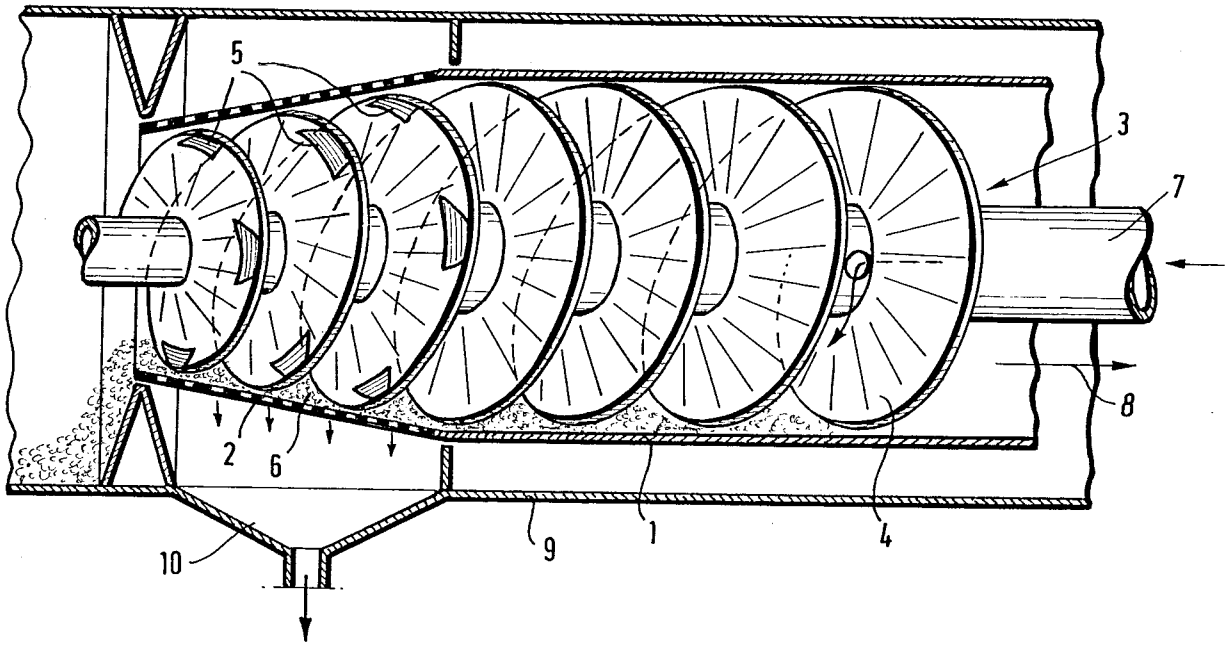
7
3
8
4
1
9
5
6
2
10

WORM CENTRIFUGE'

BACKGROUND OF THE INVENTION

1. Field of the Invention

The present invention is direced to a worm centrifuge for dewatering solids/liquid mixtures comprising a cylindrical solid bowl part and a sieve bowl part for the discharge and for the after-dewatering of the solids predewatered in the solid bowl part.

2. Description of the Prior Art

A solid bowl worm centrifuge comprising a sieve bowl part of the above type is disclosed in the German published application No. 30 43 717. The present improvement is distinguished by its high cleaning and dewatering effect.

SUMMARY OF THE INVENTION

Proceeding on the basis of this known solid bowl worm centrifuge comprising a sieve part, the object of the present invention is to quite substantially improve the dewatering effect, particularly in the after-dewatering of the solids in the sieve bowl part.

The above object is achieved, according to the present invention, in that the conveyor worm is provided with agitator elements in the region of the sieve bowl part, the agitator elements immersing into the solids layer. As practice has shown, the after-dewatering in the sieve bowl part of the centrifuge can be quite substantially increased on the basis of these inventive features. This is to be attributed to the fact that the solids layer is costantly deaggregated by the agitator elements in the sieve bowl part during conveying on the sieve bowl part, so that the liquid also proceeds towards the outside to the sieve bowl from the inwardly-disposed layers of the solids and can emerge through the openings in the sieve bowl.

According to a further feature of the invention, the agitator elements are constructed in the shape of plow shares. As practical tests have shown, the solids are circulated by these plow-share shaped agitator elements during conveying in the sieve bowl, whereby the inwardly-disposed layers are turned out towards the sieve bowl and are thereby subjected to an intensive after-dewatering process.

BRIEF DESCRIPTION OF THE DRAWING

Other objects, features and advantages of the invention, its organization, construction and operation will be best understood from the following detailed description, taken in conjunction with the accompanying drawing on which there is a single FIGURE which is a sectional view of an exemplary embodiment of the invention.

DESCRIPTION OF THE PREFERRED EMBODIMENT

Referring to the drawing, a worm centrifuge constructed in accordance with the present invention comprises a cylindrical solid bowl part 1 and of a, preferably, conically fashioned sieve bowl part 2. A conveyor worm 3 is provided within this centrifuge drum composed of the solid bowl 1 and of the sieve bowl 2, conveyor worm 3 being driven with a somewhat higher or lower rotational speed as well in comparison to the centrifuge drum during operation of the centrifuge. The worm helix 4 of the conveyor worm 3 is provided with agitator elements 5 in the region of the sieve bowl, the agitator elements 5 being arranged at the helix 4 of the conveyor worm 3 on the conveying side and immersing into the solids layer 6. The agitator elements 5 are thereby arranged uniformly distributed over the circumference of the worm helix and are constructed in the shape of plow shares. As a result of this plow-share shaped construction of the agitator elements 5, in the region of the conical sieve bowl 2, the solids layer 6 is circulated during conveying on the sieve bowl in an extremely advantageous manner and is thereby subjected to an intense after-dewatering process. As practice has shown, the dewatering effect can be enhanced up to 25% in comparison to known worm sieve centrifuges by this construction of the invention of the worm centrifuge given the same energy expense. The liquid phase arising in the solid bowl during operation of this worm centrifuge is discharged from the centrifuge drum in the direction of the arrow 8 by way of channels (not shown in detail on the drawing) arranged at the exterior of the hollow shaft 7 of the worm, whereas the concentrate arising in the conical sieve bowl in the after-dewatering process is eliminated towards the outside via a discharge 10 arranged at the housing 9.

As illustrated in the drawings, the agitator elements 5 are mounted at circumferentially spaced locations on the outer periphery of the flights of the conveyor worm. The agitator elements project axially in a lead direction, that is, in the direction in which the solids are being conveyed. They also extend generally peripherally, which is generally parallel to the outer edge of the flights. The elements are circumferentially spaced along the edge of the flights, and as shown, are uniformly spaced over the circumference of the worm helix in the location of the sieve portion of the bowl. The agitator elements project only a portion of the ways in the axial space between adjacent flights. This, as above stated, permits the solids layer to be constantly deaggregated as the agitator elements stir the solids releasing the liquid which then proceeds toward the outside of the sieve bowl from the layers of solids.

The worm centrifuge according to the present invention is not limited to the exemplary embodiment shown on the drawing. Therefore, for example, the sieve bowl 2 in the worm centrifuge constructed in accordance with the present invention can also be potentially cylindrically or slightly conically expanded towards the discharge end and in a very advantageous manner. Such a fashioning of the sieve bowl has the advantage that the discharge of the solids in this region can be accomplished with a lower conveying power. Over and above this, it may also be expedient to secure the agitator elements not only to the worm helix 4 but directly connect the same to the hollow shaft 7 of the conveyor worm 3 via appropriately-constructed arms. Furthermore, the agitator elements can also be constructed in the manner of shovels.

Although I have described by invention by reference to particular illustrative embodiments thereof, many other changes and modifications may become apparent to those skilled in the art without departing from the spirit and scope of the invention. I, therefore, intend to include within the patent warranted hereon all such changes and modifications as may reasonably and properly be included within the scope of my contribution to the art.

I claim:

1. In a worm centrifuge for dewatering solids/liquid mixtures comprising a cylindrical solid bowl portion and a sieve bowl portion connected thereto for the discharge and for the after-dewatering process of the solids predewatered in the solid bowl, and a conveyor worm having helical flights driven by drive means to move the mixture axially from one end towards the other, the improvement comprising:

a plurality of agitator elements connected to the conveyor worm in the sieve bowl portion for rotating and dipping into the solids layer, said elements extending circumferentially at the outer edge of the helical flights and projecting axially in the direction of solids movement and being circumferentially spaced along the edge of the flights.

2. The improved worm centrifuge of claim 1, wherein:

said agitator elements are constructed with a plowshare shape.

3. The improved worm centrifuge of claim 1, wherein:

said agitator elements project only a portion of the distance between edges of adjacent helical flights at the conveying side of the flights of the conveyor worm.

4. In a worm centrifuge for dewatering solids/liquid mixtures comprising a cylindrical solid bowl portion and a sieve bowl portion connected thereto for the discharge and for the after-dewatering process of the solids predewatered in the solid bowl and a conveyor worm having helical flights driven by drive means to move the mixture from one end towards the other, the improvement comprising:

agitator means located at the outer edge of the flights of the conveyor worm in the sieve bowl portion for turning inwardly disposed layers of solids outwardly toward the sieve bowl and subjecting solids to an intensive after-dewatering process, said agitator means including elements extending circumferentially along the outer edges of the flights at spaced locations therealong and projecting axially forwardly in the direction of movement of the solids.

5. The method of dewatering solids/liquid mixtures in a cylindrical solid bowl separator having an outer sieve bowl portion with a conveyor worm having flights for removing solids forwardly through the bowl, which comprises the steps of feeding the mixture to the bowl; rotating the bowl and worm; and moving the solids forwardly through the bowl, and at the outer edge of the flights of the conveyor worm continually intermittently deaggregating the solids by turning inwardly disposed layers outwardly toward the sieve bowl portion and thereby subjecting them to an intensive after-dewatering process.

6. The method of dewatering solids/liquid mixtures in a cylindrical solid bowl separator having an outer sieve bowl portion with a conveyor worm for removing solids forwardly through the bowl in accordance with the steps of claim 5, wherein the layers are turned outwardly intermittently along the edge of the flights of the worm by plow-share shaped agitator elements in the sieve bowl portion.

* * * * *